US005129959A

United States Patent [19]

Sigler

[11] Patent Number: 5,129,959

[45] Date of Patent: Jul. 14, 1992

[54] SULFUR TREATMENT OF MAGNESIUM-CONTAMINATED FE-CR-AL ALLOY FOR IMPROVED WHISKER GROWTH

[75] Inventor: David R Sigler, Sterling Heights, Mich.

[73] Assignee: General Motors Corporation, Detroit, Mich.

[21] Appl. No.: 503,403

[22] Filed: Apr. 2, 1990

[51] Int. Cl.[5] ..... C21D 8/00

[52] U.S. Cl. ..... 148/277; 148/325; 148/333; 140/540; 420/42; 420/62; 420/79; 420/87; 420/103

[58] Field of Search ..... 420/42, 43, 54, 62, 420/129, 70, 71, 79, 87, 103, 104, 115; 148/325, 333, 2, 3, 12 EA. 12.1, 6.35, 277

[56] References Cited

U.S. PATENT DOCUMENTS

| | | | |
|---|---|---|---|
| 4,052,202 | 10/1977 | Luyekx | 75/129 |
| 4,318,828 | 3/1982 | Chapman | 148/284 |
| 4,331,631 | 5/1982 | Chapman et al. | 148/243 |
| 4,588,449 | 5/1986 | Sigler | 148/285 |
| 4,661,169 | 4/1987 | Aggen et al. | 148/2 |
| 4,867,811 | 9/1989 | Wakiyama et al. | 148/277 |

FOREIGN PATENT DOCUMENTS

| | | |
|---|---|---|
| 358309 | 3/1990 | European Pat. Off. . |
| 2157321 | 10/1985 | United Kingdom . |

*Primary Examiner*—R. Dean
*Assistant Examiner*—Sikyin Ip
*Attorney, Agent, or Firm*—Douglas D. Fekete; George A. Grove

[57] ABSTRACT

A method for producing aluminum-containing ferritic stainless steel from a magnesium-contaminated melt such that the steel is suitable for growing oxide whiskers to cover the surface thereof is disclosed. The method comprises adding sulfur to the contaminated melt in an amount sufficient to increase the sulfur content not less than 1.3 time the magnesium content, whereupon the sulfur reacts with the magnesium to render the magnesium inert to whisker growth. The method also preferably comprises an addition of titanium, zirconium of hafnium in amounts sufficient to react with residual sulfur in excess of the amount required for magnesium reaction, thereby mitigating the adverse affect of sulfur on oxide adhesion.

19 Claims, No Drawings

SULFUR TREATMENT OF MAGNESIUM-CONTAMINATED FE-CR-AL ALLOY FOR IMPROVED WHISKER GROWTH

BACKGROUND OF THE INVENTION

This invention relates to formulation of aluminum-containing ferritic stainless steel that is oxidizable to produce a protective surface layer characterized by multitudinous oxide whisker formations. More particularly, this invention relates to formulation of such steel from a contaminated melt and including a sulfur addition to neutralize magnesium impurity that would otherwise inhibit whisker formation.

Aluminum-containing ferritic stainless steel is particularly useful for high temperature applications, for example, as a substrate in an automotive catalytic converter. A typical steel comprises about 15 to 25 weight percent chromium, about 3 to 6 weight percent aluminum and the balance mainly iron. When exposed to oxygen at elevated temperatures, the steel forms a surface alumina layer that protects the underlying metal against further corrosion. The alloy may contain a minor addition of yttrium or rare earth metal, such as cerium or lanthanum, to promote oxide adhesion and thereby improve high temperature corrosion resistance. It is also known to add titanium, zirconium or hafnium to refine grain size, improve workability, counteract undesirably high carbon content and increase high temperature strength.

In contrast to the relatively smooth surface of the oxide layer that typically is formed on such stainless steel, it is known to oxidize the steel surface under conditions that produce a layer comprising oxide whiskers suitable to promote the bonding to applied coating. U.S. Pat. Nos. 4,331,631 and 4,318,828 describe oxidation treatments of foil formed of such iron-chromium-aluminum alloy that produce oxide whiskers that substantially cover the foil surface.

It has been found that the presence of magnesium impurity in amounts as little as 0.002 weight percent noticeably inhibits growth of the desired whiskers. U.S. Pat. No. 4,588,449 describes a treatment for growing oxide whiskers on magnesium-contaminated foil that comprises sustained heating to sublime the magnesium. While this treatment has been generally successful for reclaiming contaminated foil for whisker growth, it nevertheless requires a prolonged and expensive high temperature treatment.

Another typical contaminant in commercial aluminum-containing ferritic stainless steel foil is sulfur. In the absence of a suitable getter, most notably yttrium or rare earth elements, sulfur tends to reduce oxide adhesion and thereby diminish corrosion protection. It has now been found that, in the absence of yttrium or rare earth getter, sulfur reacts with the magnesium impurity, and further that the magnesium sulfide product does not inhibit formation of an adherent whisker layer. However, the sulfur impurity typically found in commercial steel is on the order of 0.003 weight percent and is insufficient to react with all magnesium, which is typically on the order of 0.01 weight percent. At the same time, it is necessary to protect the steel formulation from the unwanted effects of free sulfur.

Therefore, it is an object of this invention to provide a method for formulating an aluminum-containing stainless steel foil that is contaminated by magnesium impurity sufficient to inhibit oxide whisker formation, but which formulation renders the magnesium ineffective and thereby permits growth of oxide whiskers on the surface thereof.

More particularly, it is an object of this invention to provide a method for producing an aluminum-containing ferritic stainless steel from a melt contaminated with magnesium, which method includes adding sulfur in an amount stoichiometrically sufficient to react with all magnesium impurity and thereby to prevent free magnesium that would otherwise inhibit formation of oxide whiskers during subsequent oxidation of the steel. The treatment is necessarily carried out in the absence of any addition of yttrium or rare earth metals. In one aspect of this invention, the treatment comprises a further addition of titanium, zirconium or hafnium in amounts sufficient to react with any residual free sulfur that might otherwise reduce adherence of the oxide layer.

It is a further object of this invention to provide an aluminum-containing ferritic stainless steel containing magnesium impurity in an amount otherwise sufficient to inhibit oxide whisker growth, but further including a sulfur concentration adjusted to prevent free magnesium and thereby to permit whisker growth. In one aspect of this invention, the steel further includes a Group 4 addition to react with excess sulfur and thereby promote adhesion of a subsequently formed oxide layer thereon.

It is a still further object of this invention to provide a method for growing oxide whiskers on the surface of aluminum-containing ferritic stainless steel foil prepared from a magnesium contaminated melt, which includes adding sulfur to the melt in an amount effective to react with all magnesium and thereby eliminate the detrimental effects of free magnesium on whisker growth, and which optionally includes an addition of Group 4 metal to the melt to react with any excess sulfur and thereby promote adhesion of oxide whiskers subsequently grown on the foil.

SUMMARY OF THE INVENTION

In accordance with a preferred embodiment, these and other objects are accomplished by an aluminum-containing ferritic stainless steel that is formulated to include a sulfur addition to react with magnesium present in the melt as an impurity to produce magnesium sulfide, MgS. Thus, a melt is initially prepared comprising, as major constituents, aluminum, chromium and iron. A preferred melt comprises between about 3 and 6 weight percent aluminum, between about 15 and 25 weight percent chromium and the balance substantially iron, but containing impurities, including magnesium and sulfur impurities. The melt is analyzed to determine magnesium and sulfur concentrations. Sulfur is added, preferably as iron sulfide, to increase the concentration to an amount sufficient for stoichiometric reaction with the entire magnesium concentration. Except where otherwise noted herein, concentration is designated by weight percent. Thus, following the sulfur addition, the sulfur concentration is greater than or equal to 1.3 times the magnesium concentration.

Because unreacted sulfur reduces oxide adhesion, it is desired to minimize the sulfur addition. Nevertheless, the sulfur addition preferably includes a small excess over the theoretical stoichiometric minimum of 1.3 times the magnesium concentration in order to assure complete magnesium reaction. In a further aspect of this invention, the excess sulfur is neutralized by an addition of titanium, zirconium or hafnium. These Group 4 elements not only react with excess sulfur, but also getter carbon, nitrogen and oxygen impurities in the melt. Thus, an optimum addition of Group 4 elements provides sufficient metal to react with carbon, nitrogen and oxygen, as well as the excess sulfur, and may be calculated in accordance with the following Equation 1:

$$\%\ Ti \div [3.99(\%\ C) + 3.42(\%\ N) + 2.99(\%\ O) + 1.49(\%\ S_{excess})] + \%\ Zr \div [7.60(\%\ C) + 6.52(\%\ N) + 2.85(\%\ O) + 1.90(\%\ S_{excess})] + \%\ Hf \div [14.9(\%\ C) + 12.8(\%\ N) + 5.60(\%\ O) + 2.79(\%\ S_{excess})] \geqq 1$$

wherein % refers to weight percent and $S_{excess}$ is the amount of sulfur in excess of the stoichiometric amount needed for magnesium reaction and is calculated by subtracting 1.3 times the magnesium concentration from the adjusted sulfur concentration. A portion of the carbide, nitride, oxide and sulfide reaction products with Group 4 elements may separate from the melt to form a dross. Residual reaction product in the metal, particularly Group 4 carbide and nitride, serves as a grain refiner to enhance strength and increase ductility of the product steel. A small excess of the Group 4 elements over the stoichiometric amount needed for reaction with the several impurities and excess sulfur is preferred to assure complete reaction and is not considered detrimental to the product steel.

The steel in accordance with this invention does not include an addition of yttrium or of rare earth metals, such as cerium and lanthanum, in order to achieve superior high temperature oxidation resistance and form the desired oxide whisker topography following oxidation. These agents react with sulfur preferentially to the desired magnesium and sulfur reaction, thereby releasing magnesium to inhibit whisker growth.

Following formulation of the melt including adjustment of the sulfur concentration and addition of the Group 4 elements to getter excess sulfur, the melt is cast and formed, for example, by peeling or cold rolling, into the desired steel stock, such as a thin foil for manufacturing a catalytic converter substrate. The steel is oxidized in accordance with a process described in U.S. Pat. No. 4,331,631 or U.S. Pat. No. 4,318,828, incorporated herein by reference, to produce an adherent, protective layer composed of oxide whiskers. It is found that the steel produced in accordance with this invention grows multitudinous, densely packed whiskers, despite the magnesium contamination, and further forms a tightly adherent and protective layer, despite the sulfur addition. This is accomplished without the expense of a yttrium or rare earth addition, as is common in current steel products to promote adequate oxidation resistance, and achieves the desired properties using a minimal addition of less expensive Group 4 agents.

DETAILED DESCRIPTION OF THE INVENTION

In a preferred embodiment of this invention, an aluminum-containing stainless steel is produced by an argon-oxygen decarburization (AOD) process from a magnesium-contaminated melt. A master alloy of about 20 parts by weight chromium and 75 parts by weight iron is melted in a suitable foundry vessel and treated by bubbling nitrogen or argon gas containing oxygen through the melt for decarburization. Thereafter, residual oxygen is removed by adding ferrosilicon to the melt while continuing to stir by bubbling oxygen-free argon gas. About 5 parts by weight aluminum is added to the melt to complete formulation of the major metal constituents.

In accordance with this invention, prior to casting the steel a sample of the melt is analyzed for magnesium, sulfur, oxygen, carbon and nitrogen impurities. As used herein, carbon is considered an impurity because of the low level desired in the steel. Magnesium concentration is suitably determined by spark emission spectroscopy wherein visible light from an electrical spark between the sample and an inert counterelectrode is analyzed for a wavelength associated with magnesium, whereupon the intensity of light at the wavelength is indicative of the magnesium concentration. For illustration purposes, the magnesium concentration is about 0.01 weight percent, typical of commercial iron-chromium-aluminum steel. Carbon and sulfur concentrations are determined by combustion infrared absorption spectroscopy wherein a sample of the alloy is heated in a ceramic crucible in the presence of a tin catalyst and oxygen gas, and the effluent gas is analyzed by infrared spectrometry for the presence of carbon dioxide and sulfur dioxide. The sulfur concentration in this example is about 0.005 weight percent. The carbon concentration is about 0.01 weight percent. Oxygen and nitrogen are determined by a procedure similar to the combustion spectroscopic procedure for carbon and sulfur, but wherein the sample is heated in the presence of carbon and in contact with inert helium atmosphere, whereupon gaseous nitrogen and carbon monoxide are evolved. The carbon monoxide is catalyzed to carbon dioxide and analyzed by infrared spectrometry. Nitrogen is determined by electrical conductivity. The nitrogen concentration in this example is about 0.01 weight percent. The oxygen concentration in this example is about 0.002 weight percent.

Following analysis, the sulfur concentration of the melt is adjusted for stoichiometric reaction with magnesium. Complete reaction requires a sulfur concentration that is equal to or greater than 1.3 times the magnesium concentration. For the melt in this example containing 0.01 percent magnesium, the required sulfur concentration is 0.013 percent. Since the initial sulfur concentration is 0.005 percent, an additional 0.008 percent sulfur is required. Sulfur is added in the form of a master compound, iron sulfide. In this example, iron sulfide is added to increase the sulfur concentration by 0.015 percent to produce an adjusted sulfur concentration of 0.02 weight percent, resulting in an excess of 0.007 weight percent sulfur. The excess is provided to assure complete reaction.

Also, in this example, a titanium addition of about 0.3 weight percent is made to react with the excess sulfur, forming titanium sulfide to eliminate free sulfur from the steel that would otherwise reduce oxide adhesion. The titanium also reacts with carbon to form titanium carbide, with nitrogen to form titanium nitride, and with oxygen to form titanium oxide. The titanium addition is calculated to provide more than the minimum by Equation 1 to provide an excess to assure complete reaction. A portion of the titanium reaction products may separate in dross on the melt surface.

Following the sulfur adjustment and the titanium addition, the melt surface is skimmed to remove the dross. The melt is cast into a billet, hot rolled and finally cold rolled to produce a foil about 0.05 millimeter thick. The foil surface is cleaned and oxidized to produce an oxide whisker layer. This is accomplished by heating the foil initially for 10 seconds at 900° C. in a nitrogen atmosphere containing 5 to 1,000 parts per million oxygen and thereafter oxidizing in air at 925° C. for 16 hours.

In the described embodiment, representative values for typical magnesium, sulfur, oxygen, nitrogen and carbon levels in commercial iron-chromium-aluminum melt were selected to illustrate sulfur and titanium additions in accordance with this invention. In production, the levels of contaminants varies from heat to heat. Magnesium impurity in commercial chromium-aluminum steel is typically between about 0.005 and 0.015 weight percent and may occasionally be up to 0.02 weight percent or more. A typical range for sulfur impurity is between about 0.001 and 0.005 weight percent. Oxygen impurity typically varies between about 0.001 and 0.030 weight percent. Nitrogen impurity typically varies between about 0.003 and 0.030 weight percent. Carbon impurity typically varies between about 0.010 and 0.040 weight percent. Also, the composition of a particular melt may vary over time because of separation into dross or contamination from the foundry vessel or atmosphere in contact therewith.

Table 1 shows compositions of several melts of iron-chromium-aluminum alloy prepared to further illustrate this invention.

TABLE I

| | Composition of Fe—Cr—Al Melt in Weight Percent | | | | | | | | | | |
|---|---|---|---|---|---|---|---|---|---|---|---|
| Example | Cr | Al | C | N | O | Mg | S | Ti | Zr | Hf | Fe |
| 1 | 18.9 | 5.0 | 0.01 | 0.0115 | 0.0025 | 0.007 | 0.27 | 0.163 | — | — | bal. |
| 2 | 18.8 | 5.2 | 0.01 | 0.011 | 0.001 | 0.012 | 0.02 | — | 0.245 | — | bal. |
| 3 | 18.9 | 5.0 | 0.01 | 0.0105 | 0.0015 | 0.0085 | 0.0225 | — | 0.008 | 0.545 | bal. |
| 4 | 19.4 | 5.1 | 0.013 | 0.01 | 0.002 | 0.006 | 0.017 | 0.104 | 0.201 | — | bal. |
| 5 | 19.6 | 5.0 | 0.02 | 0.009 | <0.001 | 0.013 | 0.006 | — | — | — | bal. |
| 6 | 18.8 | 5.0 | 0.01 | 0.0095 | 0.002 | 0.011 | 0.023 | — | — | — | bal. |

In each example, the melt was cast, cold rolled into a foil, and oxidized by the described process for growing oxide whiskers. The oxidized surface was visually inspected and also examined using an electron microscope.

In each Example 1 through 4, the sulfur content was greater than 1.3 times the magnesium concentration, in accordance with this invention. The Group 4 concentration was sufficient to react with excess sulfur as well as carbon, nitrogen and oxygen, in accordance with Equation 1. In each Example 1 through 4, the oxidized, cold rolled foil surface was substantially covered by tightly adherent oxide whiskers having a high aspect ratio and well suited for promoting adhesion of an applied coating. This was accomplished despite the presence of magnesium and with sulfur concentrations greater than typical impurity level and achievable by sulfur addition in accordance with this invention.

For purposes of comparison, and in contrast to Examples 1 through 4, Example 5 contains sulfur significantly less than required for complete magnesium reaction, resulting in free magnesium within the steel. The oxidized foil did not form large oxide whiskers having a high aspect ratio and covering the surface, as in Examples 1 through 4, which is attributed to the free magnesium.

In Example 6, the sulfur concentration was greater than 1.3 times the magnesium concentration so as to prevent free magnesium within the steel in accordance with this invention. But, in the absence of Group 4 addition, the excess resulted in free sulfur within the steel. The oxidized foil was covered by densely spaced, high aspect oxide whiskers, but the oxide did not exhibit the desired tight adhesion, which was attributed to the presence of unreacted sulfur.

Thus, the addition of sulfur in an amount sufficient to stoichiometrically react with magnesium has been demonstrated to mitigate the detrimental effect of magnesium upon whisker growth. The reaction of magnesium and sulfur need not be completed in the melt or at the time of casting, but rather may take place by solid state diffusion within the foil during treatment to grow the oxide whiskers. Although a precise addition is calculatable to provide stoichiometric proportions of sulfur and magnesium, in practice it is preferred to add excess sulfur to assure reaction with all magnesium. In general, an excess sulfur of 20 percent to 50 percent, or between 1.6 and 1.8 times the magnesium concentration, more than the stoichiometric concentration is believed to provide an adequate excess. Also, an addition of Group 4 metal has also been shown to scavenge excess sulfur to mitigate the adverse effects of free sulfur on oxide adhesion. An excess of Group 4 element over the stoichiometric requirement is preferred. Thus, an addition of at least 0.3 weight percent titanium is generally sufficient to assure sulfide, carbide oxide, and nitride formation. Similarly, an addition of at least 0.4 percent zirconium is sufficient to assure the desired reactions. An addition of at least 0.7 percent hafnium is also generally sufficient.

While this invention has been described in terms of certain embodiments thereof, it will be appreciated that other forms could be readily adapted by those skilled in the art. Accordingly, the scope of the invention is to be considered limited only by the following claims.

The embodiments of the invention in which an exclusive property or privilege is claimed are defined as follows:

1. A method for producing an aluminum-containing stainless steel from a magnesium-contaminated melt without additions of yttrium and rare earth metals, said steel being formed of an iron-base alloy containing aluminum and chromium and comprising a surface suitable for oxidation to form an adherent oxide layer characterized by whisker formations, said method comprising analyzing a melt of the iron-chromium-aluminum alloy to determine magnesium concentration, adding sulfur to said melt in an amount sufficient to increase the sulfur concentration to provide sulfur for complete stoichiometric reaction with magnesium, and solidifying the sulfur-adjusted melt to form said steel.

2. A method according to claim 1 wherein the sulfur concentration in the melt following the addition thereof is not less than 1.3 times the magnesium concentration.

3. A method for producing a whiskerable aluminum-containing ferritic stainless steel from a magnesium and sulfur contaminated melt without additions of yttrium and rare earth metals, said steel being formed of an iron-base alloy containing between about 3 and 6 weight percent aluminum and between about 15 and 25 weight percent chromium and comprising a surface suitable for oxidation to form an adherent alumina layer substantially covered by whiskers, said method comprising analyzing a melt of the iron-chromium-aluminum alloy to determine magnesium and sulfur concentration, adding sulfur to said melt in an amount sufficient to increase the sulfur concentration to greater than 1.3 times the magnesium content, adding a metal selected from the group consisting of titanium, zirconium, hafnium and mixtures thereof in an amount sufficient to react with residual sulfur in excess of the sulfur concentration required for complete magnesium reaction, and solidifying the sulfur-adjusted melt to form said steel.

4. The method according to claim 3 wherein the amount of sulfur added to the melt is at least 0.01 weight percent.

5. The method according to claim 3 wherein the magnesium concentration in the melt prior to the sulfur addition is on the order of 0.01 weight percent.

6. The method according to claim 3 wherein the concentration of titanium, zirconium or hafnium, following the additions thereof, are in accordance with the equation $$\%\,Ti \div [3.99(\%\,C) + 3.42(\%\,N) + 2.99(\%\,O) + 1.49(\%\,S_{excess})] + \%\,Zr \div [7.60(\%\,C) + 6.52(\%\,N) + 2.85(\%\,O) + 1.90(\%\,S_{excess})] + \%\,Hf \div [14.9(\%\,C) + 12.8(\%\,N) + 5.60(\%\,O) + 2.79(\%\,S_{excess})] \geqq 1.$$

7. The method according to claim 6 wherein the metal addition comprises at least 0.3 weight percent titanium.

8. The method according to claim 6 wherein the metal addition comprises at least 0.4 weight percent zirconium.

9. The method according to claim 6 wherein the metal addition comprises at least 0.7 weight percent hafnium.

10. A magnesium-contaminated aluminum-containing ferritic stainless steel suitable for surface oxidation to produce an adherent alumina layer characterized by whisker formations, said steel composed predominantly of an iron-base alloy containing between about 3 and 6 weight percent aluminum and between about 15 and 25 weight percent chromium and free of yttrium and rare earth metals addition, said steel further containing magnesium and sulfur in amounts effective to produce a sulfur concentration greater than 1.3 times the magnesium concentration and effective for complete stoichiometric reaction with said magnesium, said steel further containing a metal selected from the group consisting of titanium, zirconium, hafnium and mixtures thereof in an amount effective to react with the sulfur in excess of the sulfur concentration required for magnesium reaction.

11. A steel according to claim 10 wherein the magnesium concentration is at least 0.01 weight percent.

12. A steel according to claim 10 wherein the sulfur concentration is at least 0.013 weight percent.

13. A steel according to claim 10 wherein the titanium, zirconium and hafnium concentrations are in accordance with the equation $$\%\,Ti \div [3.99(\%\,C) + 3.42(\%\,N) + 2.99(\%\,O) + 1.49(\%\,S_{excess})] + \%\,Zr \div [7.60(\%\,C) + 6.52(\%\,N) + 2.85(\%\,O) + 1.90(\%\,S_{excess})] + \%\,Hf \div [14.9(\%\,C) + 12.8(\%\,N) + 5.60(\%\,O) + 2.79(\%\,S_{excess})] \geqq 1.$$

14. A method for growing oxide whiskers on a foil formed of aluminum-containing stainless steel produced from a magnesium-contaminated melt, said steel being composed of an iron-base alloy containing aluminum and chromium and substantially free of yttrium and rare earth metals addition, said method comprising analyzing a melt of the iron-chromium-aluminum alloy to determine magnesium concentration, adding sulfur to said melt in an amount sufficient to increase the sulfur concentration to provide sulfur in an amount effective for complete stoichiometric reaction with the magnesium, solidifying and forming the sulfur-adjusted melt to produce a steel foil having a surface, and oxidizing the foil surface under conditions effective to form an oxide layer characterized by multitudinous whisker formations.

15. A method according to claim 14 wherein the sulfur concentration in the melt following the addition thereof is not less than 1.3 times the magnesium concentration.

16. A method for growing oxide whiskers on a foil formed of a magnesium-contaminated aluminum-containing ferritic stainless steel, said steel being composed of an iron-base alloy containing between about 3 and 6 weight percent aluminum and between about 15 and 25 weight percent chromium and free of yttrium and rare earth metals addition, said method comprising analyzing a melt of the iron-chromium-aluminum alloy to determine magnesium and sulfur concentration, adding sulfur to said melt in an amount sufficient to increase the sulfur content to greater than 1.3 times the magnesium content and effective for complete stoichiometric reaction within said melt, adding a metal selected from the group consisting of titanium, zirconium, hafnium and mixtures thereof in an amount sufficient to react with residual sulfur in excess of the stoichiometric sulfur concentration required for complete magnesium reaction, solidifying and forming the sulfur-adjusted melt to produce a steel foil having a surface, and oxidizing the foil surface under conditions effective to form an oxide layer characterized by multitudinous whisker formations.

17. The method according to claim 16 wherein the amount of sulfur added to the melt is at least 0.01 weight percent.

18. The method according to claim 16 wherein the magnesium concentration in the melt prior to the sulfur addition is on the order of 0.01 weight percent.

19. The method according to claim 16 wherein the concentration of titanium, zirconium or hafnium, following the additions thereof, are in accordance with the equation $$\%\,Ti \div [3.99(\%\,C) + 3.42(\%\,N) + 2.99(\%\,O) + 1.49(\%\,S_{excess})] + \%\,Zr \div [7.60(\%\,C) + 6.52(\%\,N) + 2.85(\%\,O) + 1.90(\%\,S_{excess})] + \%\,Hf \div [14.9(\%\,C) + 12.8(\%\,N) + 5.60(\%\,O) + 2.79(\%\,S_{excess})] \geqq 1.$$

* * * * *